US006840141B2

(12) United States Patent
Cole

(10) Patent No.: US 6,840,141 B2
(45) Date of Patent: Jan. 11, 2005

(54) RADIAL INDEXING HEAD TOOL WITH FLOATING SPLINED PIN

(75) Inventor: Charles A. Cole, Plano, TX (US)

(73) Assignee: Brian T. Cole, Richardson, TX (US)

( * ) Notice: Subject to any disclaimer, the term of this patent is extended or adjusted under 35 U.S.C. 154(b) by 0 days.

(21) Appl. No.: 10/339,614

(22) Filed: Jan. 9, 2003

(65) Prior Publication Data

US 2004/0134314 A1 Jul. 15, 2004

(51) Int. Cl.[7] ..... B25B 23/16

(52) U.S. Cl. ..... 81/177.8; 81/58.3; 81/60; 403/97; 403/298

(58) Field of Search ..... 81/177.8, 177.7, 81/60, 440, 58, 58.1, 58.3; 403/91–93, 95–97, 298

(56) References Cited

U.S. PATENT DOCUMENTS

| | | | |
|---|---|---|---|
| 151,315 | A | 5/1874 | Rowe |
| 624,643 | A | 5/1899 | Gaylor |
| 662,966 | A | 12/1900 | Robertson |
| 928,375 | A | 7/1909 | Fricke |
| 1,077,575 | A | 11/1913 | Wutke |
| 1,109,032 | A | 9/1914 | Berstead |
| 1,217,217 | A | 2/1917 | Reagan, Jr. |
| 1,286,506 | A | 12/1918 | Berry |
| 1,355,455 | A | 10/1920 | Doughty |
| 1,568,442 | A | 1/1926 | Carver |
| 1,840,685 | A | 1/1932 | Witherup |
| 2,420,132 | A | 5/1947 | Gryiuck |
| 2,603,325 | A | 7/1952 | Pickard |
| 2,638,677 | A | 5/1953 | Sheriff |
| 2,671,367 | A | 3/1954 | Modin |
| 2,691,316 | A | 10/1954 | Brame |
| 2,708,855 | A | 5/1955 | Fish |
| 2,921,773 | A | 1/1960 | Hoelzer |

(List continued on next page.)

FOREIGN PATENT DOCUMENTS

| | | |
|---|---|---|
| WO | WO 95/34408 | 12/1995 |
| WO | WO 98/48178 | 10/1998 |
| WO | WO 99/16584 | 4/1999 |

*Primary Examiner*—Hadi Shakeri
(74) *Attorney, Agent, or Firm*—Rudolfo Siegesmund; F. Lindsey Scott

(57) ABSTRACT

A radial indexing head tool includes a handle and ratchet head, each with a splined orifice, and a floating splined pin disposed in the splined orifices for coupling them together. The floating splined pin includes a cylindrical axial retainer coupled to the handle and extending into the splined orifices, a plunger configured for axial movement within the axial retainer, and a splined cylinder configured for axial movement along the outside of the axial retainer within the splined orifices. The plunger and splined cylinder are coupled to each other through the cylindrical wall of the retainer. Movement of the splined cylinder aligns or misaligns grooves and splined portions formed on the splined cylinder relative to grooves and splined portions formed in the splined orifices to lock or unlock the ratchet head for movement relative to the handle.

20 Claims, 9 Drawing Sheets

U.S. PATENT DOCUMENTS 3,002,409 A 10/1961 Jones
3,039,339 A 6/1962 Hanson
3,119,591 A 1/1964 Malecki
3,175,436 A 3/1965 Coleman
3,188,895 A 6/1965 Jones
3,270,597 A 9/1966 Neff et al.
3,314,318 A 4/1967 Shoults
3,550,486 A 12/1970 Edwards
3,733,936 A 5/1973 Flynn
3,779,107 A 12/1973 Avery
3,854,832 A * 12/1974 Cowper ..... 403/349
4,027,558 A 6/1977 Fish
4,145,124 A 3/1979 Weisgerber
4,184,783 A 1/1980 Hall
4,244,237 A 1/1981 Sprunger
4,270,417 A 6/1981 Tesoro
4,281,601 A 8/1981 Overman
4,406,186 A 9/1983 Gummow
4,479,409 A 10/1984 Antonius
4,520,697 A 6/1985 Moetteli
4,543,007 A 9/1985 Quiogue
4,582,445 A 4/1986 Warshawsky
4,596,167 A 6/1986 White, Jr.
4,614,452 A 9/1986 Wang
4,619,540 A 10/1986 Day et al.
4,657,428 A * 4/1987 Wiley ..... 403/359.3
4,711,596 A * 12/1987 Bruderer ..... 403/348
4,747,328 A 5/1988 Howard
4,774,862 A 10/1988 Scull
4,794,829 A 1/1989 Mesenhoeller
4,800,785 A 1/1989 Christensen
4,805,494 A 2/1989 Santoro
4,901,608 A 2/1990 Shieh
4,921,271 A 5/1990 Berry et al.
4,929,113 A 5/1990 Sheu
4,982,732 A 1/1991 Morris
4,991,470 A 2/1991 Singleton
4,993,862 A 2/1991 Pelta
5,039,118 A 8/1991 Huang
5,056,805 A 10/1991 Wang
5,062,179 A 11/1991 Huang
5,123,768 A * 6/1992 Franklin ..... 403/96
5,197,817 A 3/1993 Wood et al.
5,326,186 A 7/1994 Nyberg
5,386,747 A 2/1995 Grover
5,419,221 A 5/1995 Cole
5,471,899 A 12/1995 Twomlow
5,503,048 A 4/1996 Moon
5,522,287 A 6/1996 Chiang
5,564,852 A 10/1996 Maxwell et al.
5,581,838 A * 12/1996 Rocco ..... 403/99
5,674,024 A 10/1997 Daumal Castellor
5,694,818 A 12/1997 Nickipuck
5,775,184 A 7/1998 Cole
5,820,288 A 10/1998 Cole
5,879,100 A 3/1999 Winkler
5,911,800 A 6/1999 Roberts et al.
5,941,141 A 8/1999 Whitley
6,000,299 A 12/1999 Cole
6,032,555 A 3/2000 Whitley
6,161,982 A * 12/2000 Cole ..... 403/97
6,216,565 B1 * 4/2001 McCann ..... 81/177.8

* cited by examiner

RADIAL INDEXING HEAD TOOL WITH FLOATING SPLINED PIN

The present invention relates to hand tools and particularly to hand tools having members coupled together for movement relative to each other. More particularly, the invention relates to a splined pin for coupling the members.

BACKGROUND OF THE INVENTION

Devices for coupling two members together are well known. Many of these devices allow members to be coupled and adjusted to a desired position. However, existing devices suffer from many disadvantages. In many coupling devices, it is difficult to engage and disengage the coupler.

For example, in some existing devices, the coupler must be physically pressed to lock or unlock the coupler. This can be very awkward when utilizing the devices in close areas. In addition, when pressing the coupling device to engage or disengage, the existing devices tend to bind.

A device is needed which couples two members together, allows the coupler to be easily engaged and disengaged, and does not bind.

One solution to the aforementioned deficiency was disclosed by Whitley in U.S. Pat. No. 6,032,555. Whitley discloses an indexable ratchet wrench that has a splined pin that couples the ratchet head to the handle. Whitley's pin includes a plurality of spline members that are movable in the plane of the handle and ratchet head in response to rotation of an actuator. The spline members are spring loaded to a retracted position. Each spline member includes a camming surface that engages a cam lobe formed on the actuator. As the actuator is rotated about the axis of the splined pin, the cam lobes force the spline members radially outwardly from the axis of the splined pin to an engaged position. Unfortunately, the cam will eventually experience wear and provide only limited, and thereby weakened, engagement of the spline members with the splined apertures. Moreover, the plurality of moving parts held together by a spring makes the tool susceptible to jamming and misalignment.

It would be a distinct advantage to have a coupler with a spring-loaded splined pin using a minimum number of moving parts, and especially for a coupler that eliminates the need for cam lobes that are susceptible to wear, thereby ensuring a long useful life for the tool.

SUMMARY OF THE INVENTION

The present invention is an assembly with an adjustable coupler. The assembly includes a first member, a second member and a splined pin assembly. The first member includes an upper prong with a first splined orifice and a lower prong with a second splined orifice. The second member includes a third splined orifice and is positioned between the upper prong and the lower prong with the third splined orifice coaxially aligned with the first and second splined orifices.

The splined pin assembly is disposed in the three splined orifices and is movable between an unlocked position and a locked position. The pin assembly includes a means for moving the splined pin axially in the first and second orifices between the locked position and the unlocked position. The splines of the splined pin are disposed in the first, second and third orifices in the locked position and the unlocked position.

In another aspect, the present invention is an assembly with an adjustable coupler. The assembly includes a first member having an upper prong with a first splined orifice and a lower prong with a second splined orifice. The assembly also includes a second member having a third splined orifice. The second member is positioned between the upper prong and the lower prong. Additionally, a splined pin assembly is used for engaging the first, second, and third orifices. The splined pin assembly is movable between a locked position and an unlocked position.

The splined pin assembly includes a splined cylinder, an axial retainer for aligning the splined cylinder within the first, second, and third splined orifices, a plunger for depressing the splined pin assembly downwardly to the locked position, and a coil spring for forcing the splined pin assembly to an upward position. The upward position is the locked position of the splined pin. Downward force is applied to the plunger to position the splined pin assembly in the unlocked position.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

Figure 1:
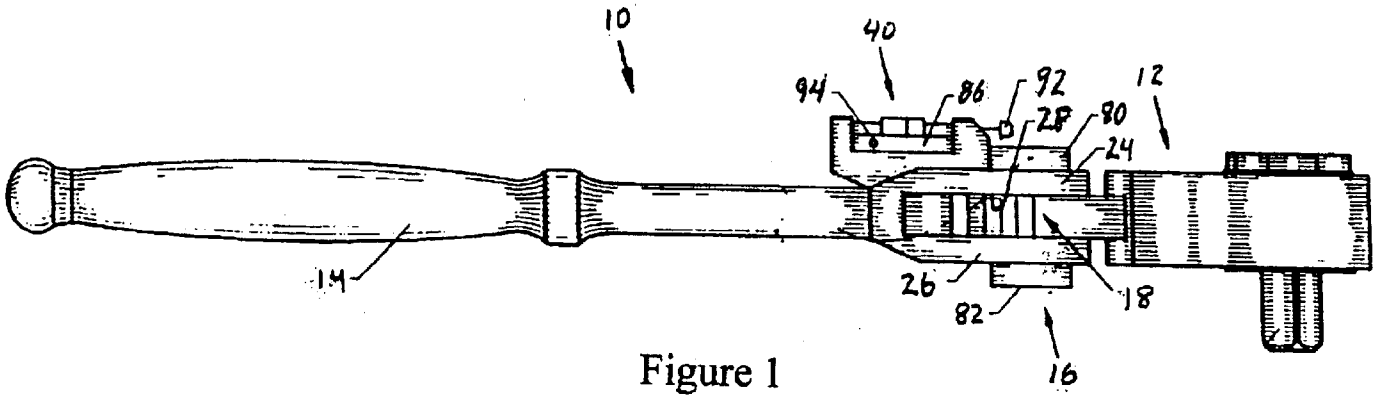
FIG. 1 is a side elevational view of an indexable wrench having a coupler in the preferred embodiment of the present invention.
Figure 2:
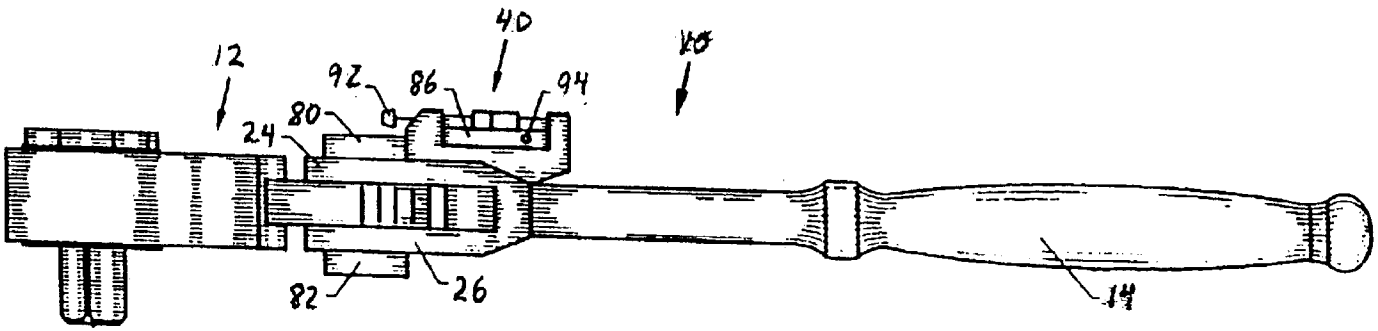
FIG. 2 is a side elevational view of a second side of the indexable wrench of FIG. 1.
Figure 3:
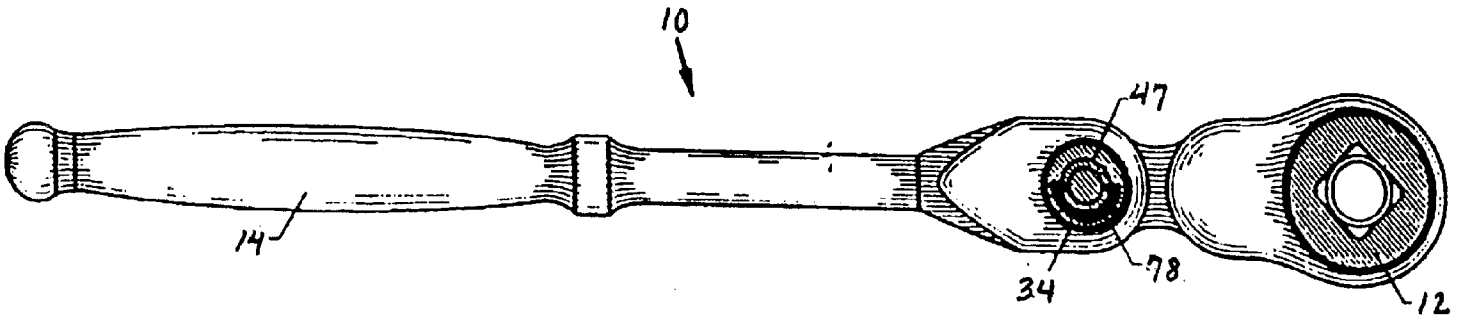
FIG. 3 is a bottom view of the indexable wrench without the locking device in the preferred embodiment of the present invention.
Figure 4:
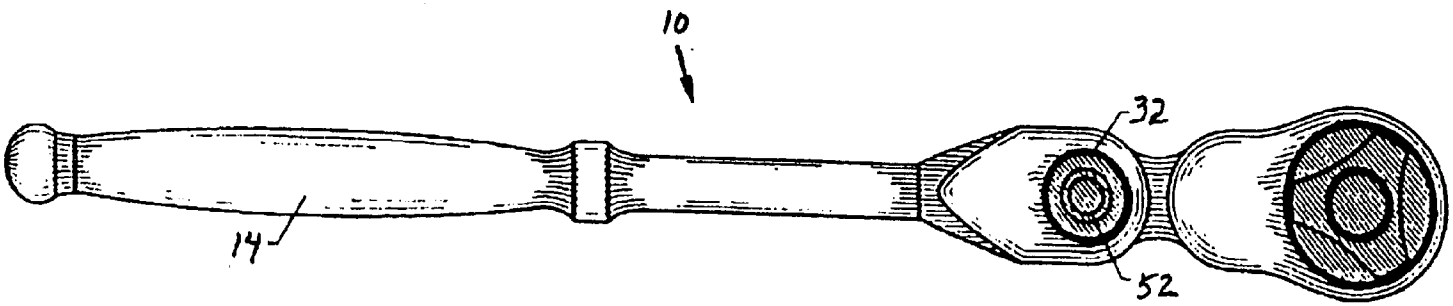
FIG. 4 is a top plan view of the indexable wrench without the locking device in the preferred embodiment of the present invention.
Figure 5:
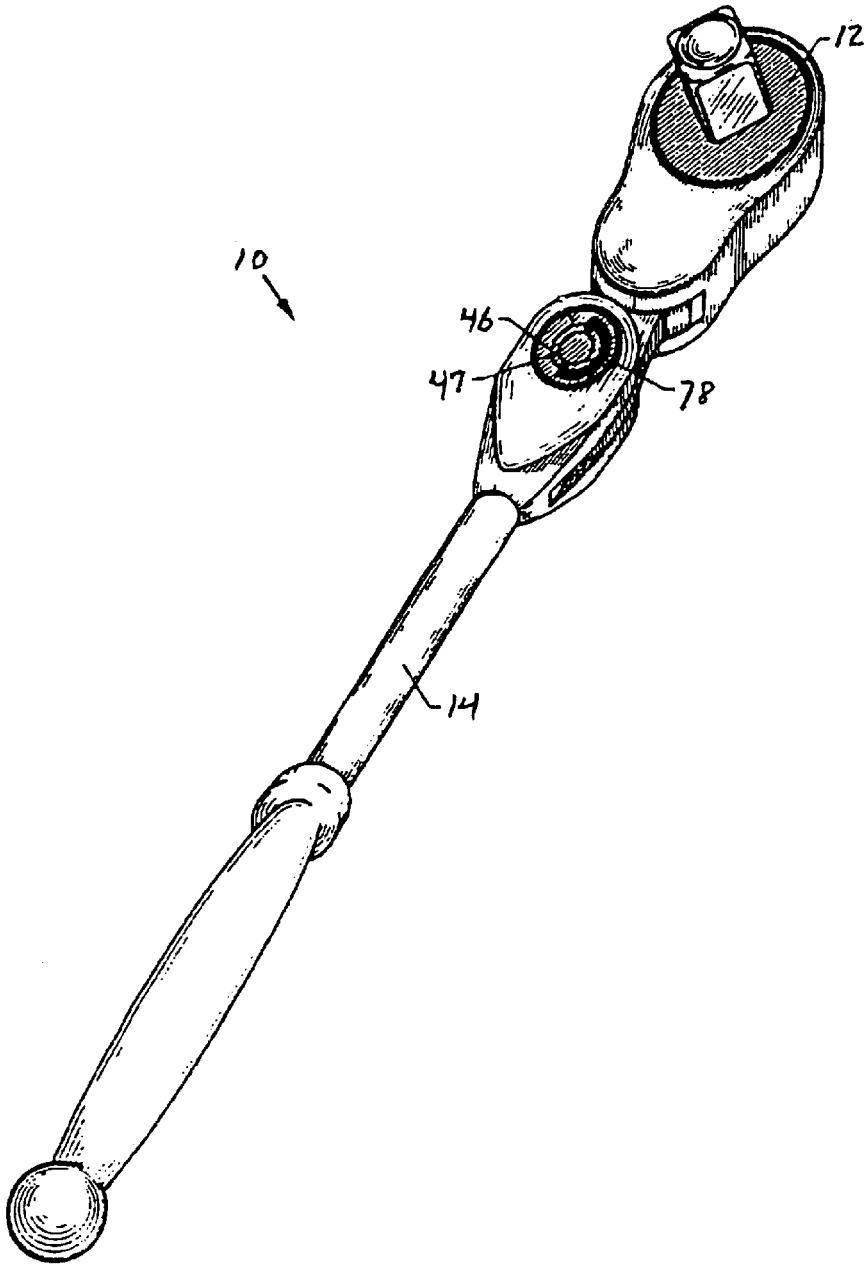
FIG. 5 is a bottom perspective view of the indexable wrench of FIG. 1 illustrating the center portion.

A radial indexing head tool with a floating splined pin 10 embodying certain features of the present invention, as illustrated in FIGS. 1–5, includes a tool head 12 coupled to a handle 14 by a splined pin assembly 16. The tool head 12, illustratively a ratchet head, includes an attaching member 18 having a splined orifice 22. The handle 14 includes an upper prong 24 and a lower prong 26. The prongs 24, 26 are disposed in spaced-apart relation with a gap 28 therebetween for receiving the tool head-attaching member 18. The upper and lower prongs 24, 26 include splined orifices 32, 34, respectively, that coaxially align with the splined orifice 22 of the tool head 12. A locking device 40 is disposed on the handle 14 to engage the splined pin assembly 16 to lock and unlock the indexable wrench 10.

Figure 6:
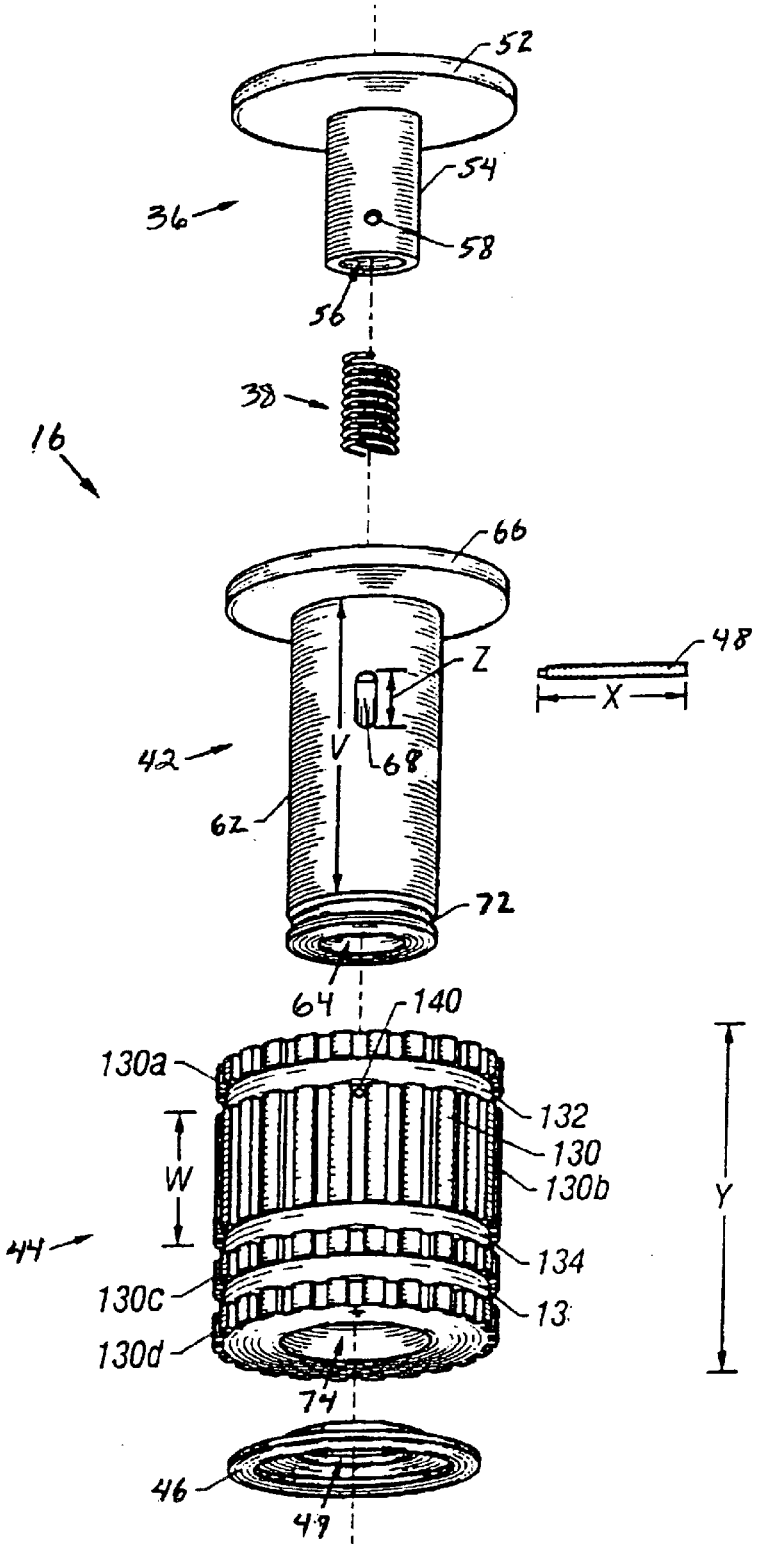
FIG. 6 is a exploded side perspective view of the splined pin.

As illustrated in FIG. 6, the splined pin assembly 16 includes a plunger 36, a coil spring 38, an axial retainer 42, a splined cylinder 44, a washer 46, and a retaining pin 48.

The plunger 36 includes a circular planar member 52 and a plunger cylinder 54 extending orthogonally from the planar member 52. A bore 56, sized to accommodate the coil spring 38, extends longitudinally through the center of the plunger cylinder 54. In addition, the plunger cylinder 54 includes two diametrically opposed apertures 58. The apertures 58 are sized to snugly receive the retaining pin 48.

The axial retainer 42 includes retainer cylinder 62 having a central longitudinal bore 64, sized to accommodate the plunger cylinder 54, and a circular flange 66 extending radially outwardly from the top of the retainer cylinder 62. The flange 66 is approximately the same size and shape as the planar member 52. The retainer cylinder 62 further includes two diametrically opposed slots 68, each having a length Z, and an annular channel 72 adjacent the bottom. The length from the top of the retainer cylinder 62 to the annular channel 72 is V.

The splined cylinder 44 has a length Y and includes a central longitudinal bore 74 that is sized to accommodate the retainer cylinder 62 therein. The length Y of the splined cylinder is slightly less than the length V of the retainer cylinder 62. The splined cylinder 44 includes a plurality of longitudinally extending external splines 130 divided by circumferential grooves 132, 134, and 136. The grooves divide the splines 130 into splined portions 130*a*, 130*b*, 130*c*, and 130*d*. In addition, the grooves have a depth equal to the height of the splines 130. The splined portions 130*a*, 130*c*, and 130*d* have a width approximately equal to the width of the grooves. However, in a preferred embodiment, the width W of the splined portion 130*b* is substantially wider than the width of the other splined portions. In alternate embodiments of the present invention, the number and size of grooves and splined portions may vary, and still provide the same functionality to be explained below.

The splined cylinder 44 further includes two diametrically opposed apertures 140. Preferably, the apertures 140 are located at an upper portion of the splined cylinder 44. The diameter of the splined cylinder 44 is also approximately equal to a length X of the retaining pin 48.

Figure 8:
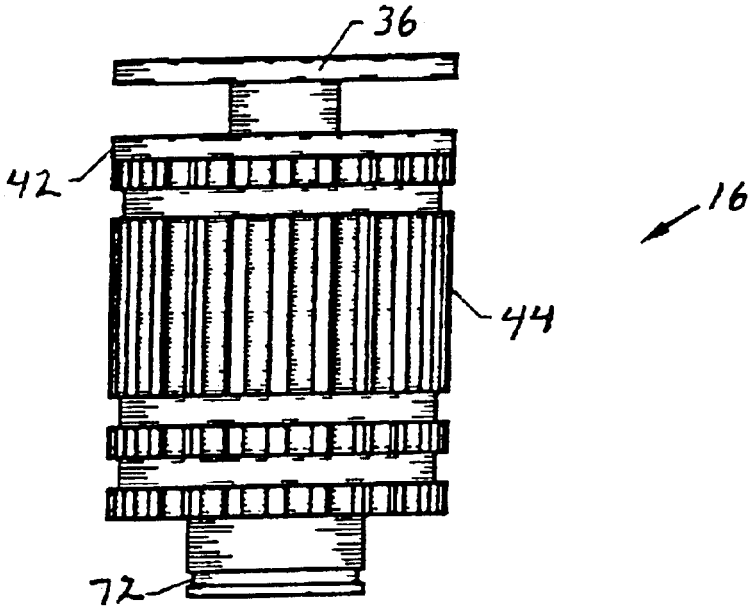
FIG. 8 is a side view of the assembled splined pin assembly with the plunger in an extended position.
Figure 10:
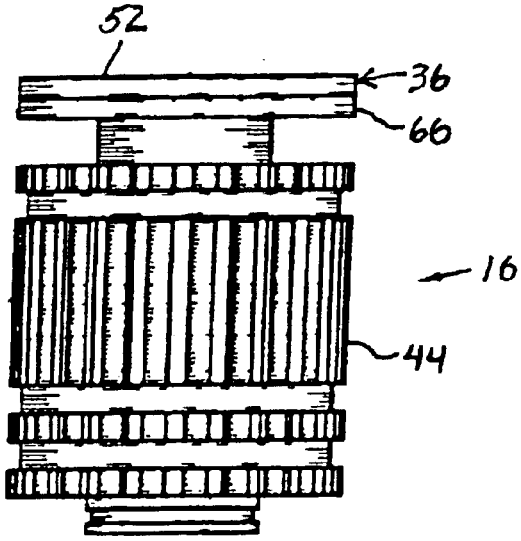
FIG. 10 is a side view of the assembled splined pin assembly with the plunger in a depressed position.

When assembled, as illustrated in FIGS. 8 and 10, the retainer cylinder 62 is positioned within the bore 74 of the splined cylinder 44. The coil spring 38 is inserted into the bore 64 of the retaining cylinder 62. The plunger 36 is then inserted into the bore 64. The splined pin assembly 16 is held in this assembled position by the retaining pin 48 which is inserted through the apertures 140, the slots 68, and the apertures 58. The coil spring forcibly presses the plunger 36 upwardly. However, the pin 48 retains the plunger 36 within the bore 64 of the retainer cylinder 62, with the length Z of the slot 68 allowing some movement of the plunger 36. Of course, the pin 48 could be replaced by a bolt, screw, threaded rod, or the like.

The annular channel 72 extends through the bottom of the splined cylinder. The washer 46, having an aperture 47 (FIGS. 3 and 5), is inserted on the lower portion of the retainer cylinder 62. The washer 46 is held in place by a U-shaped retainer 78 (shown in FIGS. 3–5).

Figure 16:
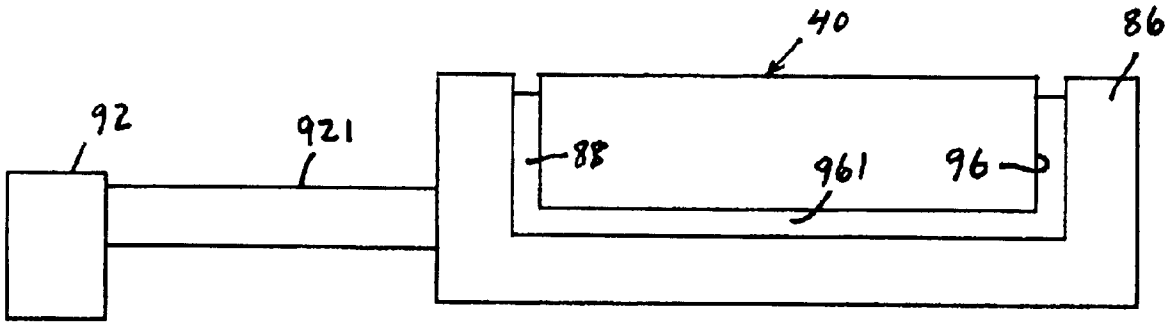
FIG. 16 is a side view of the cylinder of the locking device shown schematically in FIGS. 1–2.
Figure 17:
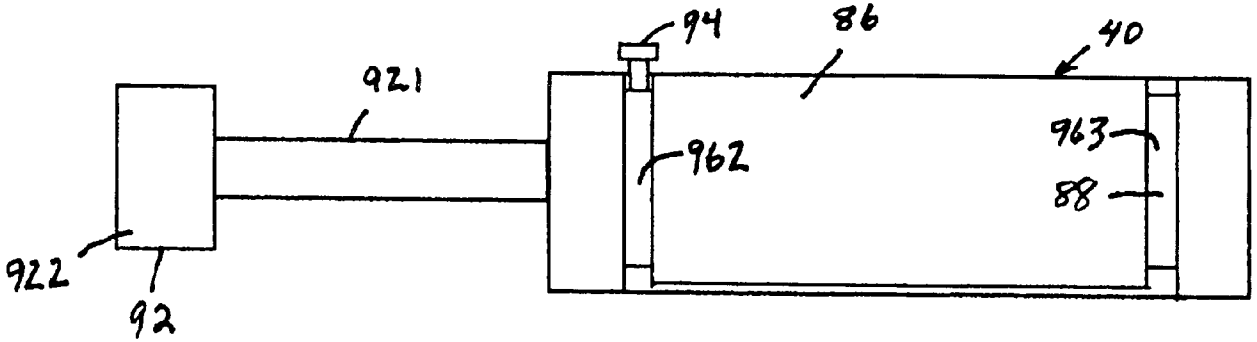
FIG. 17 is a top view of the locking device of FIG. 16.
Figure 18:
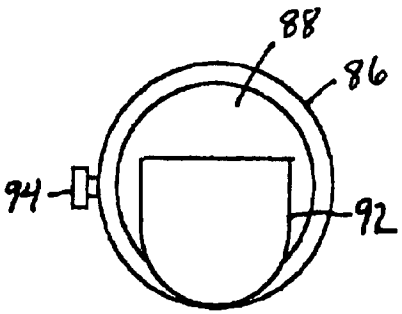
FIG. 18 is an end view of the locking device of FIG. 16.

As illustrated schematically in FIGS. 16–18, the locking device 40 is located on an upper portion of the handle 14, adjacent to boss 80. The locking device 40 includes a cylinder 86, a piston 88, an eccentric cam 92 extending from the piston 88 parallel to, and offset from, the longitudinal axis of the piston 88, and an actuator 94 extending radially from the piston 88. The cylinder 86 includes a U-shaped channel 96 having a longitudinal portion 961 and first and second radial portions 962, 963, respectively, extending orthogonally from the longitudinal portion 961. The eccentric cam 92 includes a shank 921 having a proximal end attached to the piston 88. A cam lobe 922 is disposed at the distal end of the shank 921. The piston 88 is operatively disposed for longitudinal and rotational movement in the cylinder 86 with the actuator 94 operatively disposed in the U-shaped channel 96. The locking device 40 is configured so that the eccentric cam 92 is extended to a first position for engaging the splined pin assembly 16 when the actuator 94 is disposed in the first radial portion 962. Movement of the actuator 94 in the first radial portion 962 away from the longitudinal portion 961 rotates the shank 921 and cam lobe 922 about the longitudinal axis of the piston 88, bringing the cam lobe 922 into engagement with splined pin assembly 16 to depress the plunger 36. Continued movement of the actuator 94 in the first radial portion 962 increases the amount of engagement and further depresses the plunger 36. Ultimately, the cam lobe 922 pushes downwardly on the plunger 36 sufficiently to move the splined cylinder 44 to an unlocked position. The eccentric cam 92 is retracted to a second position disengaged from the splined pin assembly 16 when the actuator 94 is moved along the longitudinal portion 961. The actuator 94 is moved into the second radial portion 963 in retain the eccentric cam 92 in the retracted position.

Figure 7:
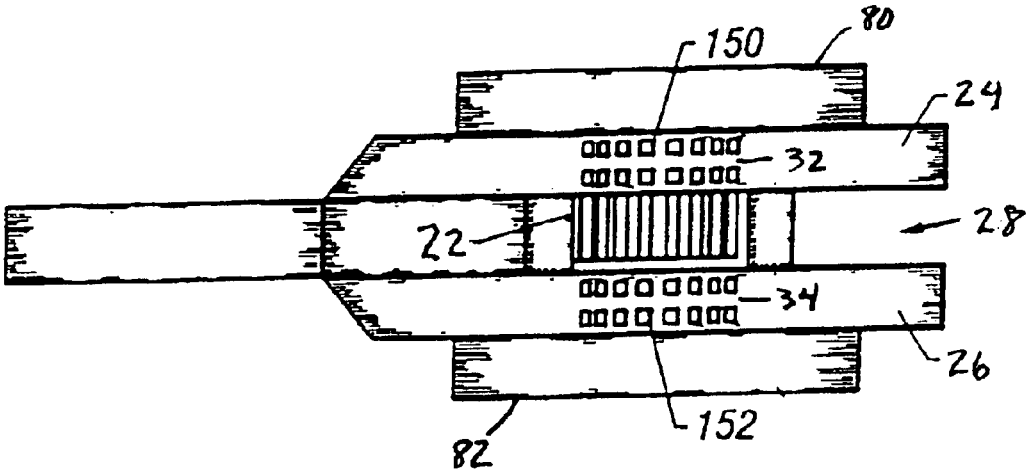
FIG. 7 is a partial cut-away side view of the splined pin inserted within the lower prong and the upper prong in the locked position.

FIG. 7 is a partial cut-away side view illustrating the splined aperture 22 in the tool head 12 and the apertures 32, 34 in the upper and lower prongs 24, 26, respectively. The upper prong 24 includes a circular boss 80 and the lower prong 26 includes a circular boss 82. Each orifice 32, 34 is sized and configured to engage the splined cylinder 44.

FIG. 8 is a side view of the splined pin assembly 16 with the plunger 36 in an extended position. The coil spring 38 provides an upward force to the plunger 36, which separates the planar member 52 of the plunger 36 from the circular flange 66 of the axial retainer 42. The plunger 36 is limited in its upward movement by movement of the retaining pin 38 in the slots 68.

Figure 9:
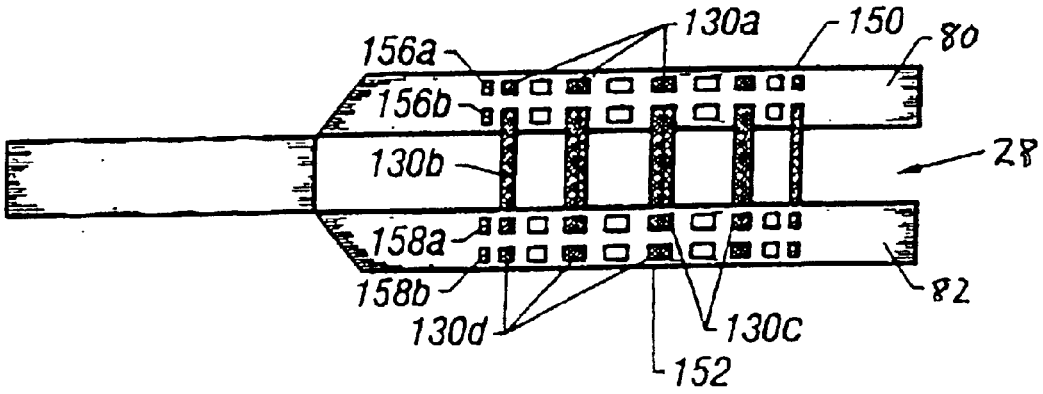
FIG. 9 is a partial cut-away side view of the splined pin engaged within the orifices in the locked position.

FIG. 9 is an enlarged partial cut-away side view of the splined cylinder 44 engaged within the orifices 32, 34 in the locked position. For simplicity, the bosses 80 and 82 and the attaching member 18 are not illustrated. For illustrative purposes, the splines of the splined cylinder 44 are shaded, while the splined rows of the orifices are unshaded. Additionally, for illustrative purposes, the spacing and size of the splines and spacing between the splines are not to scale. The splined portion 130*b* is positioned partially within the gap 28. However, a portion of the splined portion 130*b* engages the splined row 156*b*. In addition, the splined portion 130*a* engages the splined row 156*a*. The splined portion 130*c* engages the splined row 158*a* and the splined portion 130*d* engages the splined row 158*b*. In this position, the splined cylinder 44 prevents any rotational movement between the ratchet head 12 and the handle 14.

FIG. 10 is a side view of the splined pin assembly 16 with the plunger 36 in a depressed, unlocked, position. With downward force being applied to the planar member 52, the planar member 52 is positioned directly adjacent the circular flange 66.

Figure 11:
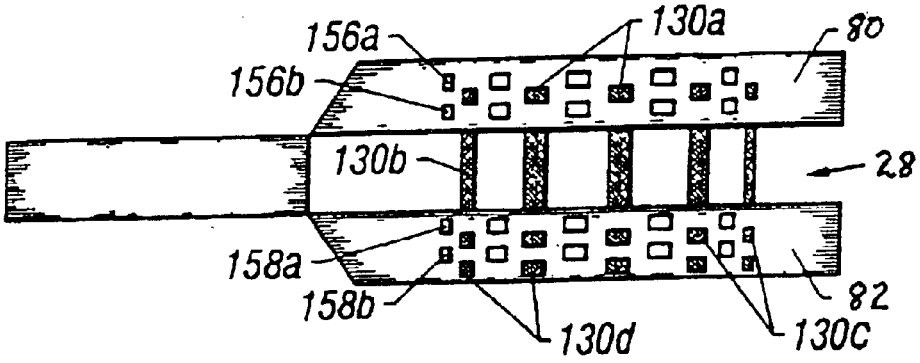
FIG. 11 is a partial cut-away side view of the splined pin engaged within the orifices in the unlocked position.

FIG. 11 is an enlarged partial cut-away side view of the splined cylinder 44 engaged within the orifices 32, 34 in the unlocked position. For simplicity, the bosses 80 and 82 and the attaching member 18 are not illustrated. Additionally, for illustrative purposes, the spacing and size of the splines and spacing between the splines are not to scale. When the planar member 52 of the plunger 36 is depressed, the splined cylinder 44 is pushed down. The splined portion 130*b* is positioned within the gap 28. The splined portion 130*a* is positioned between the splined rows 156*a* and 156*b*. The splined portion 130*c* is positioned between the splined rows 158*a* and 158*b*. The splined portion 130*d* is positioned below the splined row 158*b*. In this position, the splined cylinder 44 allows rotational movement between the handle 14 and the ratchet head 12.

Figure 12:
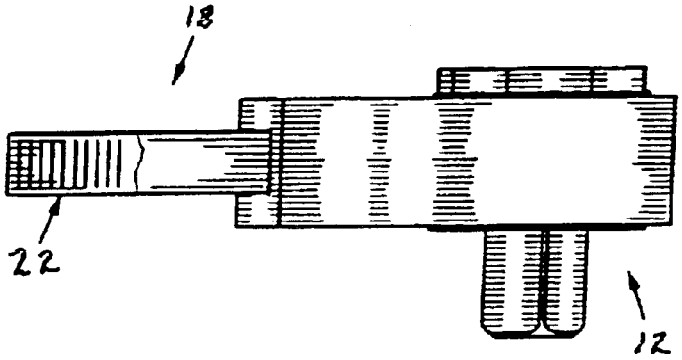
FIG. 12 is a partial cut-away side view of the ratchet member illustrating a splined orifice within the securing member.

FIG. 12 is an enlarged partial cut-away side view of the ratchet head 12 illustrating a splined orifice 22 within the attaching member 18. When positioned within the gap 28 between the upper prong 24 and the lower prong 26, the splined cylinder 44 engages the splined orifice 22. As discussed above, when the splined cylinder 44 is in the locked position, the attaching member 18 is unable to rotate in relationship to the handle 14. In the unlocked position, the attaching member 18 is free to rotate relative to the handle 14.

Figure 13:
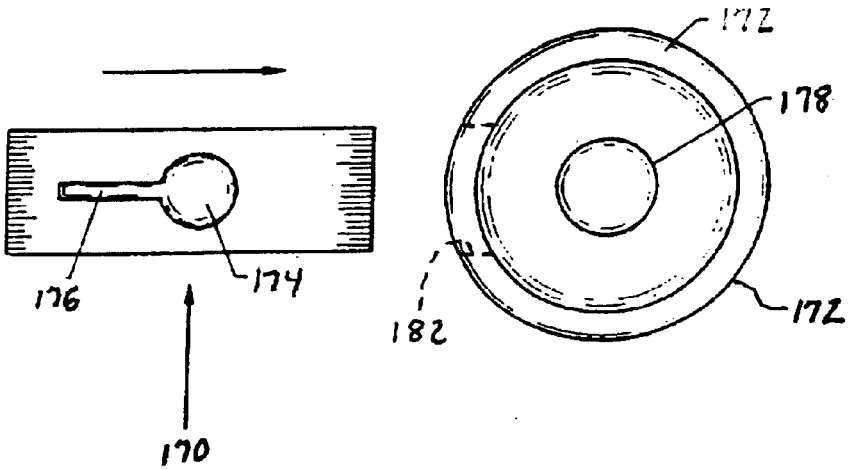
FIG. 13 is a top plan view of the boss, planar surface, and a locking bar in an alternate embodiment of the present invention.
Figure 14:
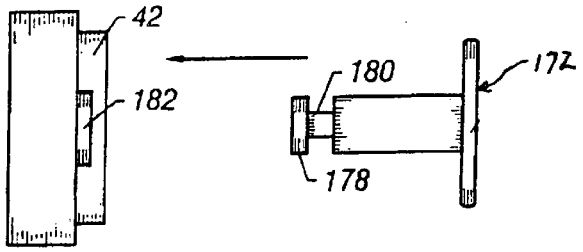
FIG. 14 is a side view of the plunger having an axial extension for use with a locking bar of FIG. 13.

FIGS. 13 and 14 illustrate an alternative locking device. The alternative locking device includes a locking bar 170 and a plunger 172. The locking bar 170 includes an opening 174 and a slot 176 extending from the opening 174. The plunger 172 includes a button 178 and a pin 180 attached to the button 178. The button 178 is sized to pass through the opening 174 and the pin 180 is sized to fit in the slot 176. The boss 82 includes an opening 182 for receiving the locking bar 170. To operate the alternative locking device, the user moves the locking bar 170 through the opening 182, with opening 174 and a portion of the slot 176 disposed above the planar member 52. The plunger 172 is aligned with the opening 174 so that the button 178 can be pushed downwardly against the planar member 52 to depress the splined cylinder 44. As the button 178 moves downwardly, the user moves the locking bar 170 laterally to capture the pin 180 in the slot 176 with the button 178 disposed against the bottom surface of the locking bar 170. Thus, the button 178 is prevented from moving upwardly by the locking bar 170, thereby applying a continuous force against the planar member 52.

With reference to FIGS. 1–11, the operation of the indexable wrench 10 will now be explained. The splined pin assembly 16 typically remains in a locked position. In the locked position, the splined cylinder 44 is pressed upwardly by the coil spring 38. In the locked position, the splined cylinder 44, with its associated splined portions 130*a*, 130*b*, 130*c*, and 130*d* engage the splined rows located within the splined orifices 150 and 152, thus preventing the rotational movement of the ratchet head 12 relative to the handle 14.

When the operator desires to rotate the ratchet head 12 to another position, the planar member 52 of the plunger 36 is depressed. The splined cylinder 44 moves downwardly to a position where the splined portions of the splined cylinder 44 are disengaged from the splined rows of the splined orifices 32, 34. When the splines are disengaged, the ratchet head 12 is allowed to rotate relative to the handle 14. When the desired position of the ratchet head 12 is reached, the plunger 36 is released, thereby locking the ratchet head 12 in place.

At times, the operator may desire to keep the splined pin assembly 16 unlocked for a period of time. The locking device 40 may then be utilized to provide constant downward force to the plunger 36. The eccentric cam 92 is moved forward to position the cam lobe 922 directly above the planar member 52. By moving the actuator 94 in the slot 96, the cam lobe 922 engages and depresses the plunger 36 to move the splined cylinder 44 to the unlocked position. One advantage of the locking device 40 is that the user can unlock and lock the indexable wrench 10 in small areas to where constant depression by the user's finger is not desired or possible. Of course, in other situations, the locking device 40 may simply be more convenient.

The indexable wrench 10 provides many advantages over existing indexable wrenches. The wrench 10 utilizes the spring-loaded splined pin assembly 16 to lock and unlock two members of the wrench 10 in a desired position. By utilizing the axial retainer 42 as well as the dual prongs 24, 26 of the handle 14, the splined pin assembly 16 does not bind. The axial retainer 42 keeps the splined pin assembly 16 aligned within the orifices 32, 34 of the prongs 24, 26. Essentially, the plunger 36 captively floats within the axial retainer 42 to prevent binding.

In addition to suffering from continually binding, existing indexable wrenches also have difficulty locking and unlocking their couplers. By utilizing a spring-loaded splined pin assembly 16 and the locking device 40, the indexable wrench 10 may be easily locked and unlocked. Additionally, the coupling mechanism in the preferred embodiment of the present invention is much stronger than couplers in conventional wrenches because of the dual prongs 24, 26. In existing couplers, two members are joined together by a pin being positioned within two orifices. However, this existing configuration only provides for one shear point. With the preferred embodiment of the present invention, the two prongs 24, 26 provide two shear points.

The indexable wrench 20 also offers some protection when inadvertently dropped. To prevent damage to the coupler 22, the bosses 80 and 82 provide protection from impact to the coupler. Additionally, the upper boss 80 provides protection against accidental disengagement of the coupler. Although an indexable wrench has been used in describing the splined pin assembly 16, any two members that are rotatably joined may be used. Additionally, variations in the size, number and shape of the splines and channels may be used for the splined pin assembly 16.

Figure 15:
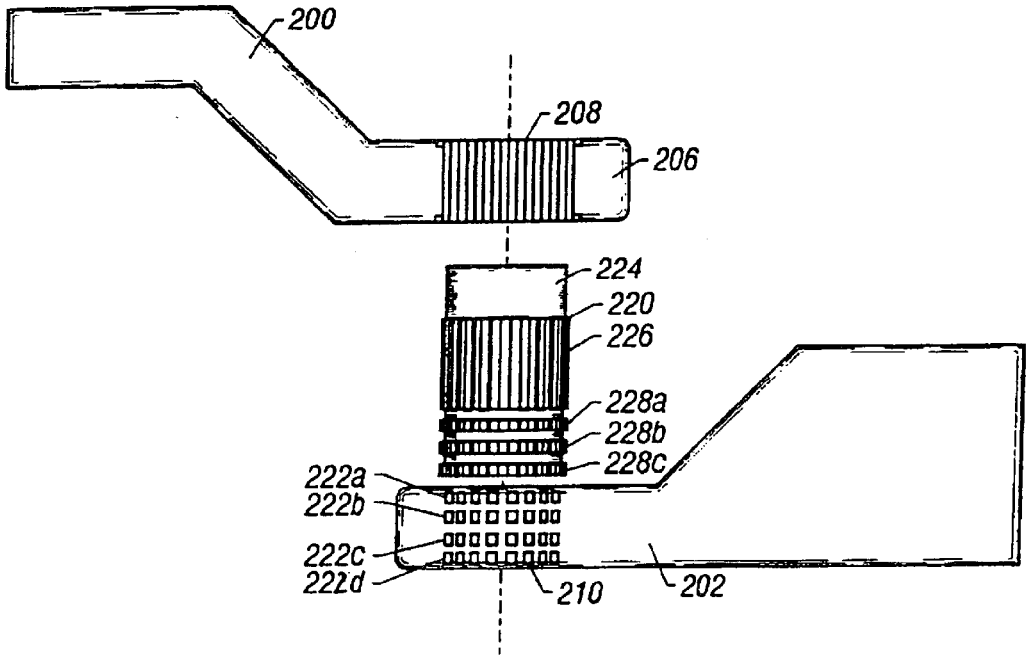
FIG. 15 is a partial cut-away side view of two members in an alternate embodiment of the present invention.

FIG. 15 is a partial cut-away side view of two members 200 and 202 in an alternate embodiment of the present invention. A splined cylinder 220 may be utilized to join the members 200 and 202. The splined cylinder is illustrated without the other parts of the coupler (plunger, axial retainer, spring, etc.) for simplicity. The splined cylinder includes a plurality of longitudinally extending external splines divided by circumferential grooves. The grooves divide the splines into splined portions 226, 228*a*, 228*b*, and 228*c*. Additionally, the splined cylinder includes a smooth portion 224. The splined cylinder 220 is very similar to the cylinder 44 with the exception of the smooth portion 224 and an additional splined portion 228*c*. In this alternate embodiment, the member 200 only has one prong 206 with a splined orifice 208. The second member 202 has a splined orifice 210. The splined orifice includes four splined rows 222*a*, 222*b*, 222*c*, and 222*d*. The splined cylinder 220 is positioned and operated in the same manner as described above for the splined cylinder 96.

While the apparatus shown and described has been characterized as being preferred, it will be readily apparent that various changes and modifications could be made therein without departing from the scope of the invention as defined in the following claims.

What is claimed is:

1. An indexing head tool comprising:

a handle having a first splined orifice and a second splined orifice;

a tool head having a third splined orifice;

a splined pin assembly coupled to the handle and tool head, the splined pin assembly comprising:

a retainer positioned within the first splined orifice and the second splined orifice;

a splined cylinder slidingly engaged to the retainer for movement thereon;

a plunger sliding engaged to the retainer for movement thereon;

wherein the plunger and the splined cylinder move independent of the retainer;

wherein the plunger is affixed to the splined cylinder by a connector extending at least partially through the retainer; and wherein the third splined orifice prohibits movement of the connector out of the plunger, the retainer, and the splined cylinder.

2. The tool of claim 1 wherein the retainer comprises a central longitudinal bore and the plunger is configured for movement in the central longitudinal bore, the splined cylinder moving on the retainer in response to movement of the plunger.

3. The tool of claim 1 further comprising: a plurality of splines on the splined cylinder engage the first splined orifice, the second splined orifice, and the third splined orifice when the splined cylinder is located in a locked position, thereby keeping the handle in a fixed position relative to the tool head; and wherein displacement of the splined cylinder into an unlocked position causes the plurality of splines to disengage the first splined orifice and the second splined orifice, thereby allowing the handle to change positions relative to the tool head.

4. An indexing head tool comprising:

a handle;

a tool head coupled to the handle by a splined pin assembly, the splined pin assembly comprising a retainer, a plunger coupled to the retainer for movement therein, and a splined cylinder configured for movement on the retainer in response to movement of the plunger;

a cam lock for moving the plunger from a locked position to an unlocked position;

wherein the cam lock comprises a cylinder, a piston disposed for longitudinal and rotational movement in the cylinder, and a cam lobe coupled to the piston; and wherein the cam lock further comprises an actuator and the cylinder further comprises a channel, the actuator being coupled to the piston and disposed in the channel for movement between a locking position and an unlocking position.

5. The tool of claim 4 further comprising:

wherein the cam lock is coupled to the tool for engagement with the splined pin assembly, the cam lock being moveable between a retracted position, a locking position, and an unlocking position;

wherein the cam lobe is positioned away from the plunger when the cam lock is in the retracted position;

wherein the cam lobe is positioned over the plunger and does not depress the plunger into the unlocked position when the cam lock is in the locking position; and wherein the cam lobe depresses the plunger into the unlocked position when the cam lock is in the unlocking position.

6. The tool of claim 5 wherein the cam lock comprises a cam lobe, the cam lobe being configured to engage the splined pin assembly to an unlocking position as the cam lobe moves from the unlocking position to the locking position.

7. An indexing tool comprising:

a handle;

a tool head coupled to the handle;

a splined pin assembly far coupling the tool head to the handle, the splined pin assembly comprising a retainer, a plunger, and a splined cylinder;

wherein the plunger comprises a plunger aperture;

wherein the plunger is affixed to the splined cylinder via a pin extending into the plunger aperture;

wherein the splined cylinder and the plunger are configured for sliding movement on opposite sides of the retainer;

wherein a plurality of splines on the splined cylinder engage the handle and the tool head when the splined cylinder is located in a locked position, thereby keeping the handle in a fixed position relative to the tool head; and wherein displacement of the plunger causes displacement of the splined cylinder into an unlocked position causes the plurality of splines to disengage the handle and the tool head, thereby allowing the handle to change positions relative to the tool head.

8. An indexing tool comprising:

a handle;

a tool head coupled to the handle by a splined pin assembly, the splined pin assembly comprising: a plunger comprising a plunger aperture;

a retainer comprising a slot, the retainer being configured for sliding engagement with the plunger;

a splined cylinder comprising a splined cylinder aperture, the splined cylinder being configured for sliding engagement with the retainer;

a pin sized substantially the same as the splined cylinder aperture and the plunger aperture, the pin being positioned within the splined cylinder aperture, the slot, and the plunger aperture;

wherein the pin affixes the plunger to the splined cylinder;

wherein the tool head or handle prohibits movement of the pin out of the splined cylinder aperture, the slot, and the plunger aperture; and wherein the retainer can be displaced relative to the plunger and the splined cylinder.

9. An indexing toll comprising:

a handle;

a tool head coupled to the handle;

a splined pin assembly for coupling the tool head to the handle, the splined pin assembly comprising:

a retainer having a central longitudinal retainer bore;

a cylindrical plunger configured for longitudinal movement in the retainer bore;

a splined cylinder having a central longitudinal cylinder bore;

wherein the retainer is configured for longitudinal movement in the cylinder bore;

wherein the splined cylinder comprises at least three splined portions located at different positions along the longitudinal axis of the splined cylinder;

wherein one of the splined portions engages one of the handle and the tool head regardless of whether the splined pin assembly is in a locked position or an unlocked position;

wherein when the splined pin assembly is in the locked position, at least two of the splined portions engage the handle or tool head not engaged by the splined portion engaging one of the handle and the tool head, thereby keeping the handle in a fixed position relative to the tool head with a plurality of shear points; and wherein when the splined pin assembly is in the unlocked position, the at least two splined portions disengage the handle or tool head not engaged by the splined portion engaging one of the handle and the tool head, thereby allowing the handle to change positions relative to the tool head.

10. The tool of claim 9 further comprising: means for coupling the plunger to the splined cylinder and for coupling the plunger and splined cylinder to the retainer for movement relative thereto.

11. The tool of claim 9 wherein the tool head comprises a first splined orifice having a first plurality of splined portions and first plurality of grooves and the handle comprises a second splined orifice having a second plurality of splined portions and second plurality of grooves and the splined cylinder comprises a third plurality of splined portion and a third plurality of grooves, the third plurality of splined portions engaging the first and second pluralities of splined portions to rotationally lock the tool head to the handle.

12. The tool head of claim 11 wherein the third plurality of splined portions aligns with the first and second plurality of grooves to unlock the tool head for rotational movement relative to the handle.

13. The tool of claim 9 wherein the splined cylinder moves from a locked position to an unlocked position in response to movement of the plunger.

14. A splined pin assembly comprising:

a plunger comprising a plunger aperture;

a retainer comprising a slot, the retainer being configured for sliding engagement with the plunger;

a splined cylinder comprising a splined cylinder aperture, the splined cylinder being configured for sliding engagement with the retainer;

a pin sized substantially the same as the splined cylinder aperture and the plunger aperture, the pin being positioned within the splined cylinder aperture, the slot, and the plunger aperture;

wherein the pin affixes the plunger to the splined cylinder; and wherein the retainer can be displaced relative to the plunger and the splined cylinder.

15. The splined pin assembly of claim 14 further comprising:

wherein the displacement of the retainer is limited by the freedom of movement of the pin within the slot.

16. The splined pin assembly of claim 15 further comprising:

wherein a spring positioned within the retainer exerts a force on the plunger and the retainer, keeping the plunger positioned away from the retainer in the absence of an opposing force.

17. The splined pin assembly of claim 16 further comprising:

wherein a splined orifice on a tool head or a handle prohibits movement of the pin out of the plunger, the retainer, and the splined cylinder.

18. The splined pin assembly of claim 17 further comprising:

wherein the splined cylinder comprises a plurality of splined portions;

wherein at least two of the plurality of splined portions engage a tool head and at least one of the plurality of splined portions engage a handle when the splined pin assembly is in a locked position, thereby creating a plurality of shear points with respect to the handle, the splined pin assembly, and the tool head; and wherein the at least two of the plurality of splined portions do not engage the tool head when the splined pin assembly is in an unlocked position, thereby allowing the handle to rotate with respect to the tool head.

19. The splined pin assembly of claim 18 further comprising:

wherein the retainer further comprises a flange and a retainer cylinder, the axis of the retainer cylinder being orthogonal to the plane of the flange; and wherein the slot extends through the wall of the retainer cylinder and wherein the long side of the slot is aligned with the axis of the retainer cylinder.

20. The splined pin assembly of claim 19 further comprising:

wherein the splined cylinder aperture extends through the wall of the splined cylinder;

wherein the plunger further comprises a planer member and a plunger cylinder, the axis of the plunger cylinder being orthogonal to the plane of the planer member; and wherein the plunger aperture extends through the wall of the plunger cylinder.

* * * * *